US007638110B1

(12) United States Patent
Yoshikawa et al.

(10) Patent No.: US 7,638,110 B1
(45) Date of Patent: Dec. 29, 2009

(54) CARBON FIBER

(75) Inventors: Hidekazu Yoshikawa, Shizuoka (JP); Taro Oyama, Shizuoka (JP); Takaya Suzuki, Shizuoka (JP); Harumitsu Enomoto, Shizuoka (JP)

(73) Assignee: Toho Tenax Co., Ltd., Tokyo (JP)

( * ) Notice: Subject to any disclaimer, the term of this patent is extended or adjusted under 35 U.S.C. 154(b) by 0 days.

(21) Appl. No.: 12/166,479

(22) Filed: Jul. 2, 2008

(51) Int. Cl.
*D01F 9/12* (2006.01)

(52) U.S. Cl. ..... 423/447.2; 423/447.1

(58) Field of Classification Search ..... 423/447.2, 423/447.1
See application file for complete search history.

(56) References Cited

U.S. PATENT DOCUMENTS

| | | | | |
|---|---|---|---|---|
| 4,902,460 | A * | 2/1990 | Yagi et al. | 264/83 |
| 6,444,187 | B1 * | 9/2002 | Miyoshi et al. | 423/447.2 |
| 2003/0143398 | A1 * | 7/2003 | Ohki et al. | 428/398 |
| 2007/0184348 | A1 * | 8/2007 | Sakurai et al. | 429/231.8 |
| 2008/0096110 | A1 * | 4/2008 | Bito et al. | 429/220 |
| 2008/0118427 | A1 * | 5/2008 | Leon y Leon | 423/447.2 |
| 2008/0152574 | A1 * | 6/2008 | Tanaka et al. | 423/447.2 |
| 2008/0206525 | A1 * | 8/2008 | Jacobs et al. | 428/195.1 |
| 2008/0291369 | A1 * | 11/2008 | Nagai et al. | 349/76 |

FOREIGN PATENT DOCUMENTS

| | | |
|---|---|---|
| JP | 2001131833 A | 5/2001 |
| JP | 2003073932 A | 3/2003 |
| JP | 2007177368 | 7/2007 |

OTHER PUBLICATIONS

English Language Abstract to JP 2001-131833.
English Language Abstract to JP 2003-073932.
English Language Abstract to JP 2001-131833, published May 15, 2001.
English Language Abstract to JP 2003-073932, published Mar. 12, 2003.

* cited by examiner

*Primary Examiner*—Stuart Hendrickson
*Assistant Examiner*—Michelle Hou
(74) *Attorney, Agent, or Firm*—Norris McLaughlin & Marcus, P.A.

(57) ABSTRACT

According to the present invention, there is disclosed a carbon fiber having a strand tensile strength of 6,100 MPa or more, a strand tensile modulus of 340 GPa or more and a density of 1.76 g/cm$^3$ or more and possessing, on the surface, striations oriented in a direction parallel to the fiber axis, wherein the distance between striations in a 2×2 μm area of the carbon fiber surface when observed by a scanning probe microscope is 0.1 to 0.3 μm, the root mean square surface roughness Rms (5 μm) in a 5×5 μm area of the carbon fiber surface when observed by a scanning probe microscope is 20 to 40 nm, and the root mean square surface roughness Rms (0.5 μm) when measured in a 0.5×0.5 μm area is 2 to 12 nm.

4 Claims, 5 Drawing Sheets

CARBON FIBER

TECHNICAL FIELD

The present invention relates to a carbon fiber which can be compounded with a resin to be made into a composite material of high performance.

BACKGROUND ART

As the process for production of carbon fiber, there is a well-known process which comprises subjecting a raw material fiber [e.g. a polyacrylonitrile (PAN)] used as a precursor fiber, to an oxidation treatment and then to a carbonization treatment to obtain a carbon fiber (see, for example, Patent Literature 1). The carbon fiber obtained thus has good properties such as high tensile strength, high tensile modulus and the like.

In recent years, composite materials produced using a carbon fiber [e.g. a carbon fiber-reinforced plastic (CFRP)] are finding ever increasing applications in various industries. The following requirements are becoming stronger particularly in industries such as sport, leisure, aerospace, automobile and the like.

(1) Higher performance (high strength and high modulus)

(2) Lighter weight (light fiber weight and low fiber content)

(3) Exhibition of higher properties in compounding of composite material (improvement in carbon fiber surface property and interface property)

In order to obtain a composite material of higher performance in compounding of a carbon fiber and a matrix material (e.g. a resin), it is important that the matrix material is improved in properties; further, it is essential that the carbon fiber per se is improved in surface property, strength and modulus. That is, a composite material of higher performance (high strength and high modulus) can be obtained by compounding a carbon fiber having a high adhesivity to matrix material, with a matrix material to uniformly disperse the carbon fiber in the matrix material.

Investigations have been made heretofore on the improvement of carbon fiber in surface property, strength and modulus (see, for example, Patent Literature 2).

However, conventional carbon fibers are insufficient in performance for use in production of a composite material satisfying the above-mentioned higher performance.

Patent Literature 1: JP-A-2001-131833 (Claims, page 5)

Patent Literature 2: JP-A-2003-73932 (Claims)

DISCLOSURE OF THE INVENTION

The present inventor made a study in order to solve the above-mentioned problems. In the course of the study, the present inventor found that a carbon fiber having a tensile strength, a tensile modulus and a density, each of a given range and possessing, on the surface, striations oriented in the fiber axis direction shows good adhesivity to a matrix material and gives a composite material of high performance. The finding has led to the completion of the present invention.

Hence, the present invention aims at providing a carbon fiber which has alleviated the conventional problems.

The present invention, which has achieved the above aim, is as described below.

[1] A carbon fiber having a strand tensile strength of 6,100 MPa or more, a strand tensile modulus of 340 GPa or more and a density of 1.76 g/cm$^3$ or more and possessing, on the surface, striations oriented in a direction parallel to the fiber axis.

[2] The carbon fiber according to [1], wherein the distance between striations in a 2×2 μm area of the carbon fiber surface when observed by a scanning probe microscope is 0.1 to 0.3 μm, the root mean square surface roughness Rms (5 μm) in a 5×5 μm area of the carbon fiber surface when observed by a scanning probe microscope is 20 to 40 nm, and the root mean square surface roughness Rms (0.5 μm) when measured in a 0.5×0.5 μm area is 2 to 12 nm.

[3] The carbon fiber according to [1], wherein the surface oxygen concentration (O/C) of carbon fiber when measured by an X-ray photoelectron spectrometer is 0.13 or more, the surface nitrogen concentration (N/C) of carbon fiber when measured by the spectrometer is 0.05 or less, the crystallite size measured by wide-angle X-ray diffractometry is 2 nm or more, and the band intensity ratio (D/G) of 1,360 cm$^{-1}$ band intensity (D) and 1,580 cm$^{-1}$ band intensity (G) when measured by Raman spectrometry is 1.3 or less.

[4] The carbon fiber according to [1], which is obtained by subjecting, to an oxidation treatment and a carbonization treatment, an acrylic fiber having an orientation degree of 90.5% or less when measured by wide-angle X-ray diffractometry (diffraction angle: 17°).

[5] The carbon fiber according to [1], which is obtained by firing an oxidized fiber showing a mass reduction ratio of 7% or less when immersed in dimethylformamide for 12 hours.

The carbon fiber of the present invention is high in strand tensile strength, strand tensile modulus and density and moreover possesses striations oriented in the fiber axis direction on the surface of the carbon fiber; therefore, the carbon fiber, when compounded with a matrix material and made into a composite material, functions as a reinforcing material showing good adhesivity to the matrix material. The present carbon fiber is low in fluffing and end breakage.

BRIEF DESCRIPTION OF THE DRAWINGS

In FIG. 1, 2 is a carbon fiber; 4 is a wave-shaped mountain; 6 is a wave-shaped valley; a is a distance between wave-shaped mountains (a distance between striations); b is a height difference between wave-shaped mountain and wave-shaped valley (a striation roughness); and c is a surface roughness in a very small surface area.

BEST MODE FOR CARRYING OUT THE INVENTION

The present invention is described in detail below.

The carbon fiber of the present invention fiber has a strand tensile strength of 6,100 MPa or more, preferably 6,150 to 6,400 MPa, a strand tensile modulus of 340 GPa or more, preferably 340 to 370 GPa, and a density of 1.76 g/cm$^3$ or more, preferably 1.76 to 1.80 g/cm$^3$, and possesses, on the surface, striations oriented in a direction parallel to the fiber axis. Incidentally, in the present specification, strand tensile strength may be described simply as strength, and strand tensile modulus may be described simply as modulus.

Figure 1:
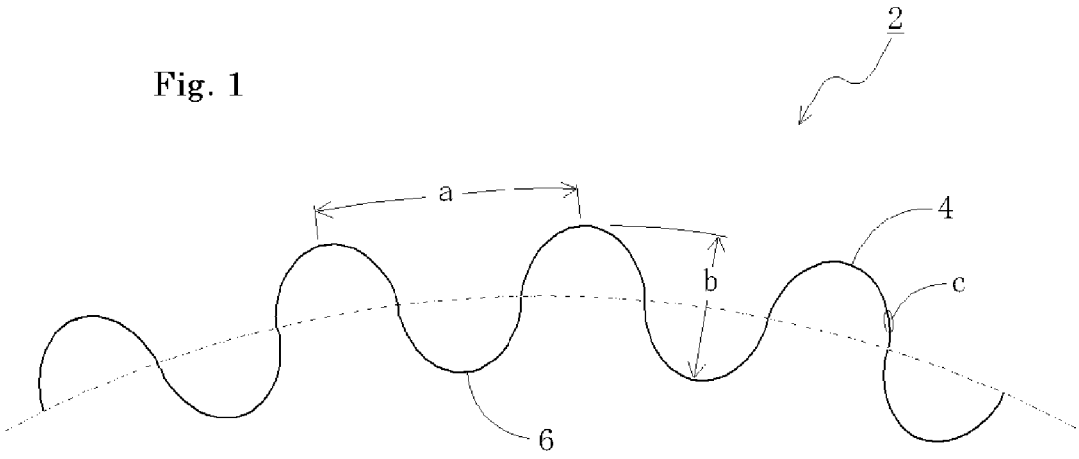
FIG. 1 is a partially sectional schematic drawing of an example of the carbon fiber of the present invention.

FIG. 1 is a partially sectional schematic drawing showing an example of the section of the carbon fiber of the present invention obtained by cutting the fiber vertically relative to the fiber axis. As shown in FIG. 1, the carbon fiber 2 of the present example has, on the surface, striations oriented in a direction parallel to the fiber axis. That is, the present carbon fiber 2 has a wave-shaped surface wherein bending is repeated along the periphery of the fiber section obtained by cutting the fiber by an arbitrary plane intersecting the fiber axis at right angles. In FIG. 1, 4 indicates a wave-shaped mountain and 6 indicates a wave-shaped valley.

a indicates a distance between wave-shaped mountains, i.e. a striation distance. b indicates a height difference between wave-shaped mountain and wave-shaped valley, i.e. a striation roughness. c indicates a surface roughness of very small fiber surface area. The striation distance a and the striation roughness b can be measured using a scanning probe microscope.

The striations can be formed by controlling the shape of the nozzle hole for discharging a spinning solution. Also, the striations can be formed spontaneously by employing wet spinning or wet on dry spinning. The shape, etc. of striations can be controlled by controlling spinning conditions and/or post-treatment conditions.

In the carbon fiber of the present invention, the striation distance a is preferably 0.1 to 0.3 μm. The striation distance a is a measurement value obtained by observing a length and width area of 2×2 μm of carbon fiber surface using a scanning probe microscope. The detail thereof is described in Examples which appear later.

The striation roughness b is preferably 20 to 40 nm. The striation roughness b indicates a root mean square surface roughness Rms (5μ) calculated from the measurement data obtained by observing a length and width area 5×5 μm of carbon fiber surface using a scanning probe microscope. The detail thereof is described in Examples which appear later.

The surface roughness c is preferably 2 to 12 nm. The surface roughness c indicates a root mean square surface roughness Rms (0.5μ) calculated from the measurement data obtained by observing a length and width area 0.5×0.5 μm of carbon fiber surface using a scanning probe microscope. The detail thereof is described in Examples which appear later. The surface roughness c can be controlled by controlling the quantity of electricity required for surface treatment.

The average diameter of the carbon fiber is preferably 4.5 to 6.0 μm, more preferably 5.0 to 6.0 μm.

The surface oxygen concentration (O/C) and surface nitrogen concentration (N/C) of the carbon fiber are measured by an X-ray photoelectron spectrometer (ESCA). The surface oxygen concentration (O/C) of the carbon fiber is preferably 0.13 or more, more preferably 0.13 to 0.26. When the surface oxygen concentration (O/C) is less than 0.13, the adhesivity between carbon fiber and matrix resin is inferior, causing a reduction in the physical properties of the composite material obtained. Meanwhile, when the surface oxygen concentration (O/C) of the carbon fiber is more than 0.26, the carbon fiber is low in strength.

The surface nitrogen concentration (N/C) is preferably 0.05 or less. When the surface nitrogen concentration (N/C) is more than 0.05, it is impossible to obtain the required physical properties of carbon fiber. The surface oxygen concentration (O/C) and surface nitrogen concentration (N/C) can be controlled by controlling the conditions of surface treatment.

The crystallite size can be measured by wide-angle X-ray diffractometry. The crystallite size is preferably 2 nm or more, more preferably 2.1 to 2.5 nm. The carbon fiber of the present invention has a structure in which crystalline portions formed by growth of graphite surface and carbonaceous amorphous portions are mixed with each other. When the crystallite size is less than 2 nm, the growth of graphite surface is weak and no carbon fiber of high strength can be obtained.

The band strength ratio (D/G) of 1,360 cm$^{-1}$ band strength (D) and 1,580 cm$^{-1}$ band strength (G), measured by Raman spectrometry is preferably 1.3 or less, more preferably 0.95 to 1.3.

The amorphous portions show a peak of band strength (D) at 1,360 cm$^{-1}$, and the crystalline portions formed by growth of graphite surface show a peak of band strength (G) at 1,580 cm$^{-1}$. When the band strength ratio (D/G) is more than 1.3, the growth of graphite surface is weak and no carbon fiber of high strength can be obtained. When the band strength ratio (D/G) is less than 0.95, the growth of graphite surface is striking. In this case, the flexibility of carbon fiber structure is impaired, which is not preferred.

The crystallite size can be controlled by the operating conditions of carbonization furnace, described later. As the temperature of carbonization furnace is made higher, the crystallite size tends to become larger.

The carbon fiber of the present invention is preferably obtained by subjecting an acrylic fiber having an orientation degree of 90.5% or less, preferably 89 to 90% when measured by wide-angle X-ray diffractometry (diffraction angle: 17°), to an oxidation treatment and a carbonization treatment. When the orientation degree is more than 90%, the drawing ratio of the acrylic fiber used as a raw material for carbon fiber needs to be made high (large) and there is a fear of occurrence of end breakage; therefore, such an orientation degree is not preferred.

The carbon fiber of the present invention is preferably obtained by using, as a raw material, an oxidized fiber showing a mass reduction ratio of 7% or less when immersed in dimethylformamide (DMF) for 12 hours and subjecting the oxidized fiber to a carbonization treatment. When the mass reduction ratio is larger than 7%, the oxidized fiber is insufficient in oxidation of precursor fiber. Such an insufficient oxidized fiber is not preferred because it invites end breakage in carbonization step and gives a carbon fiber low in strength.

The carbon fiber of the present invention can be produced, for example, by the following process.

<Precursor Fiber>

As the precursor fiber used in production of the present carbon fiber, there can be used, with no restriction, a pitch-based fiber, a tar-based fiber and an acrylonitrile-based fiber, which are all known. Of these, an acrylic fiber is preferred and more preferred is an acrylic fiber having an orientation degree of 90.5% or less when measured by wide-angle X-ray diffractometry (diffraction angle: 17°). Specifically explaining, a monomer containing acrylonitrile in an amount of 90 mass % or more, preferably 95 mass % or more is homo-polymerized or copolymerized with other monomer; the spinning solution of the resulting (co)polymer is spun to prepare a raw material for carbon fiber. As the other monomer used in copolymerization, there can be mentioned, for example, acrylic acid, methyl acrylate, itaconic acid, methyl methacrylate and acrylamide. As the spinning method, there can be used any of wet spinning and wet on dry spinning. With wet spinning, the carbon fiber obtained has, on the surface, striations formed spontaneously; therefore, wet spinning is preferred particularly. A carbon fiber having striations is preferred because it has good adhesivity to a matrix resin. In the wet spinning, the spinning solution is discharged into a coagulating solution; the resulting coagulated acrylic fiber is then subjected appropriately to known steps such as water washing, drying, drawing and the like; thereby, a precursor fiber is obtained.

<Oxidation Treatment>

The precursor fiber is then subjected to an oxidation treatment in a heated air of 200 to 280° C. In this treatment, stretching is conducted at a stretching ratio of 0.85 to 1.30. In order to obtain a carbon fiber of high strength and high modulus, the stretching ratio is preferably 0.95 or more. In this oxidation treatment, the precursor fiber as a raw material is converted into an oxidized fiber having a fiber density of 1.3 to 1.5 g/cm$^3$. As to the stretching proportion in the oxidation treatment, there is no particular restriction. The stretching ratio may be in the above range in total.

<First Carbonization Treatment>

In the process for production of the present carbon fiber, in the first carbonization treatment step, the above-obtained oxidized fiber is subjected to a primary stretching treatment at a stretching ratio of 1.03 to 1.06 in an inert atmosphere in a temperature range of 300 to less than 800° C. Then, the oxidized fiber subjected to the primary stretching treatment is subjected to a secondary stretching treatment at a stretching ratio of 0.9 to 1.01 in an inert atmosphere in a temperature range of 300 to less than 800° C., to obtain a first carbonization treatment fiber having a fiber density of 1.50 to 1.70 g/cm$^3$.

<First Carbonization Treatment-Primary Stretching Treatment>

In the first carbonization treatment step, the oxidized fiber is subjected to gradual temperature elevation, in the above-mentioned temperature range, from a low temperature (300° C.) to a high temperature (less than 800° C.). In this step, the modulus, density, crystallite size, etc. of the fiber, described in the following (1) to (3) change.

In the primary stretching treatment of the first carbonization treatment step, the oxidized fiber is subjected to temperature elevation and, while the fiber is in the following temperature elevation ranges, stretching is conducted at a total stretching ratio of 1.03 to 1.06.

(1) A temperature elevation range from when the modulus of oxidized fiber has dropped to the minimum, to when the modulus increases to 9.8 GPa.

(2) A temperature elevation range up to when the density of oxidized fiber reaches 1.5 g/cm$^3$.

(3) A temperature elevation range up to when the crystallite size of oxidized fiber as measured by wide-range X-ray diffractometry (diffraction angle: 26°) reaches 1.45 nm.

Figure 2:
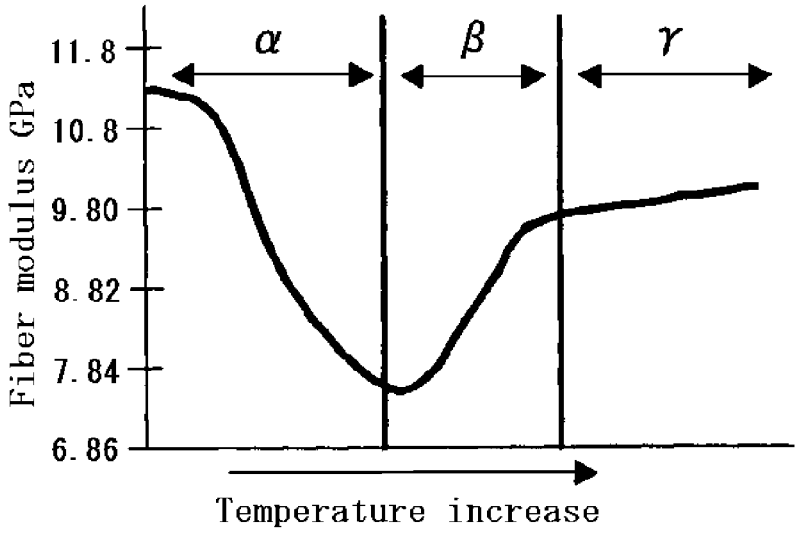
FIG. 2 is a graph showing the change of the modulus of a PAN-based oxidized fiber, relative to the temperature increase, in the primary stretching of first carbonization step.

The temperature elevation range from when the modulus of oxidized fiber has dropped to the minimum, to when the modulus increases to 9.8 GPa, is a range β shown in FIG. 2.

By conducting stretching (1.03 to 1.06 times) in the temperature elevation range from when the modulus of oxidized fiber has dropped to the minimum, to when the modulus increases to 9.8 GPa, end breakage is suppressed, the low-modulus portions of oxidized fiber are stretched efficiently and high orientation is achieved, and a primary stretching treatment fiber of high density can be obtained.

Meanwhile, stretching to 1.03 times or more before the modulus of oxidized fiber drops to the minimum, that is, in a range α, is not preferred because end breakage increases and the primary stretching treatment fiber obtained is strikingly low in strength.

Also, when stretching is conducted to 1.03 times or more after the modulus dropped to the minimum and then has increased to 9.8 GPa, that is, in a range γ, the modulus of the resulting fiber is high and forced stretching is conducted and, therefore, fiber defects and voids increase, impairing the effect of stretching. Hence, the primary stretching treatment is conducted in the above modulus range.

By conducting stretching (1.03 to 1.06 times) in a temperature elevation range up to when the density of oxidized fiber reaches 1.5 g/cm$^3$, an increase in orientation degree is realized while the generation of voids is suppressed, and a primary stretching treatment fiber of high quality can be obtained.

In contrast, when the primary stretching is conducted to 1.03 times or more in a high density range of more than 1.5 g/cm$^3$, generation of voids is promoted by forced stretching and the final carbon fiber comes to have structural defects and a low density; therefore, such stretching is not preferred. Hence, the primary stretching treatment is conducted in the above density range.

Incidentally, when the stretching ratio in primary stretching is less than 1.03 times, the effect of stretching is low and no carbon fiber of high strength can be obtained. When the stretching ratio is higher than 1.06 times, end breakage occurs and no carbon fiber of high quality and high strength can be obtained.

<First Carbonization Treatment-Secondary Stretching Treatment>

In the secondary stretching treatment of the first carbonization treatment step, the fiber after primary stretching treatment is subjected to temperature elevation and, during the temperature elevation, stretched at 0.9 to 1.01 times in (1) a temperature elevation range in which the density of the fiber continues to increase and (2) a temperature elevation range in which the crystallite size of the fiber observed by wide-angle X-ray diffractometry (diffraction angle: 26°) is not larger than 1.45 nm.

Figure 4:
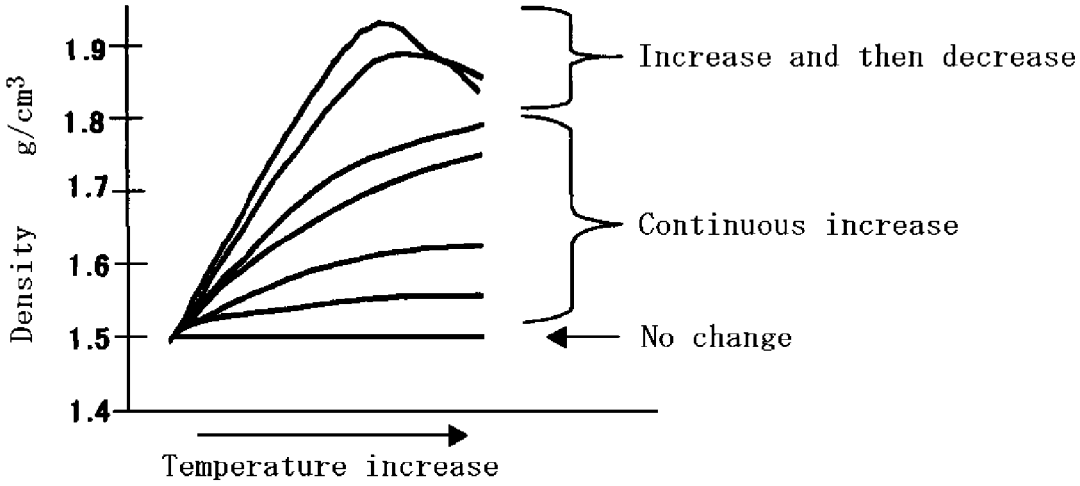
FIG. 4 is a graph showing the change of the density of a fiber subjected to the primary stretching treatment of first carbonization step, relative to the temperature increase, in the secondary stretching of first carbonization step.

In the secondary stretching treatment of the first carbonization treatment step, there are, as shown in FIG. 4, three conditions in which the density of fiber changes, i.e. a condition in which the density shows no increase with an increase in carbonization temperature, a condition in which the density continues to increase, and a condition in which the density increases and then decreases.

When the secondary stretching treatment is conducted at a stretching ratio of 0.9 to 1.01 times under one of the above three conditions, i.e. the condition in which the density of the fiber after primary stretching treatment continues to increase, the generation of voids is suppressed and there can be obtained a final carbon fiber of high density. The condition in which the density continues to increase, can be realized by controlling the temperature condition in the secondary stretching.

In contrast, when the secondary stretching treatment is conducted in a period of fiber density decrease, the generation of voids in carbon fiber is promoted and no carbon fiber of high density can be obtained. Further, when a period of no change of fiber density is included in the secondary stretching treatment, there is no density improvement in the secondary stretching treatment and there can be obtained no final carbon fiber of high strength. Therefore, the secondary stretching treatment is conducted in a temperature elevation range in which the fiber density continues to increase.

Further, the secondary stretching treatment is conducted at a stretching ratio of 0.9 to 1.01 times in a temperature elevation range in which the crystallite size of the fiber after primary stretching treatment when measured by wide-angle X-ray diffractometry (diffraction angle: 26°) is 1.45 nm or less. By such stretching treatment, the fiber is made more dense with no crystal growth, the generation of voids is suppressed, and there can be obtained a final carbon fiber of high density.

When the secondary stretching treatment is conducted in a temperature elevation range in which the crystallite size becomes larger than 1.45 nm, the carbon fiber obtained has an increased number of voids. Moreover, the obtained fiber is lower in quality owing to end breakage and there can be obtained no carbon fiber of high strength. Therefore, the secondary stretching treatment is carried out in the above-mentioned range of crystallite size.

Incidentally, when the stretching ratio is less than 0.9 times in the secondary stretching treatment, the first carbonization treatment fiber is strikingly low in orientation degree when measured by wide-angle X-ray diffractometry (diffraction angle: 26°), making it impossible to obtain a carbon fiber of high strength. When the stretching ratio is higher than 1.01 times, end breakage is incurred and there can be obtained no carbon fiber of high quality and high strength. Therefore, in the secondary stretching treatment, the stretching ratio is preferred to be in a range of 0.9 to 1.01 times.

In order to obtain a carbon fiber of high strength, the first carbonization treatment fiber preferably has an orientation degree of 76.0% or more when measured by wide-angle X-ray diffractometry (diffraction angle: 26°).

When the orientation degree is less than 76.0%, no carbon fiber of high strength can be obtained. In order to obtain an orientation degree of 76.0% or more, it is necessary that a stretching ratio of 0.95 or more is employed in the oxidation treatment and the above-mentioned conditions are employed in the first carbonization step.

In the first carbonization treatment step, there are conducted the primary stretching treatment and secondary stretching treatment of oxidized fiber, under the above-mentioned conditions, whereby a first carbonization treatment fiber can be obtained. The first carbonization treatment step may be conducted, using one or more furnaces, continuously or in two or more stages.

<Second Carbonization Treatment>

In the second carbonization treatment step, the first carbonization treatment fiber is stretched in an inert atmosphere in a temperature range of 800 to 1,600° C. with temperature elevation, to obtain a second carbonization treatment fiber. The second carbonization treatment step consists of primary stretching treatment and secondary stretching treatment.

<Second Carbonization Treatment-Primary Stretching Treatment>

In the primary stretching treatment of the second carbonization treatment step, the first carbonization treatment fiber is stretched with temperature elevation in a temperature elevation range in which the density of the fiber continues to increase, in a temperature elevation range in which the nitrogen content of the fiber is kept at 10 mass % or more, and in a temperature elevation range in which the crystallite size of the fiber when measured by wide-angle X-ray diffractometry (diffraction angle: 26°) is 1.47 nm or less.

Figure 5:
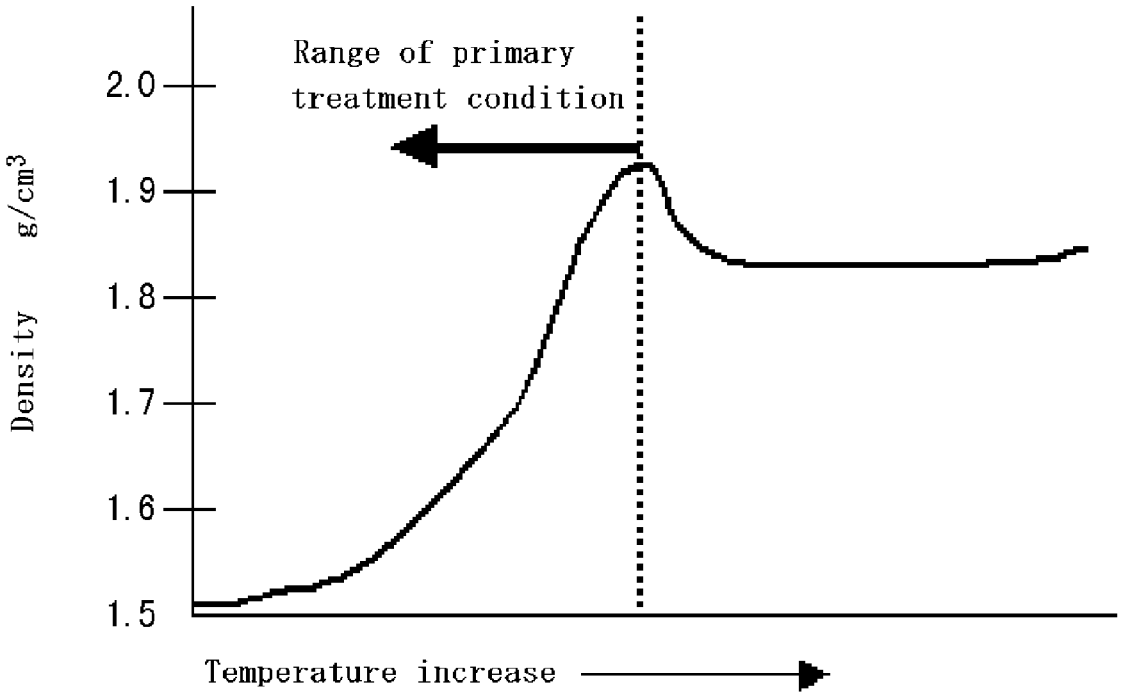
FIG. 5 is a graph showing the change of the density of a fiber subjected to a first carbonization treatment, relative to the temperature increase, in the primary stretching of second carbonization step.
Figure 6:
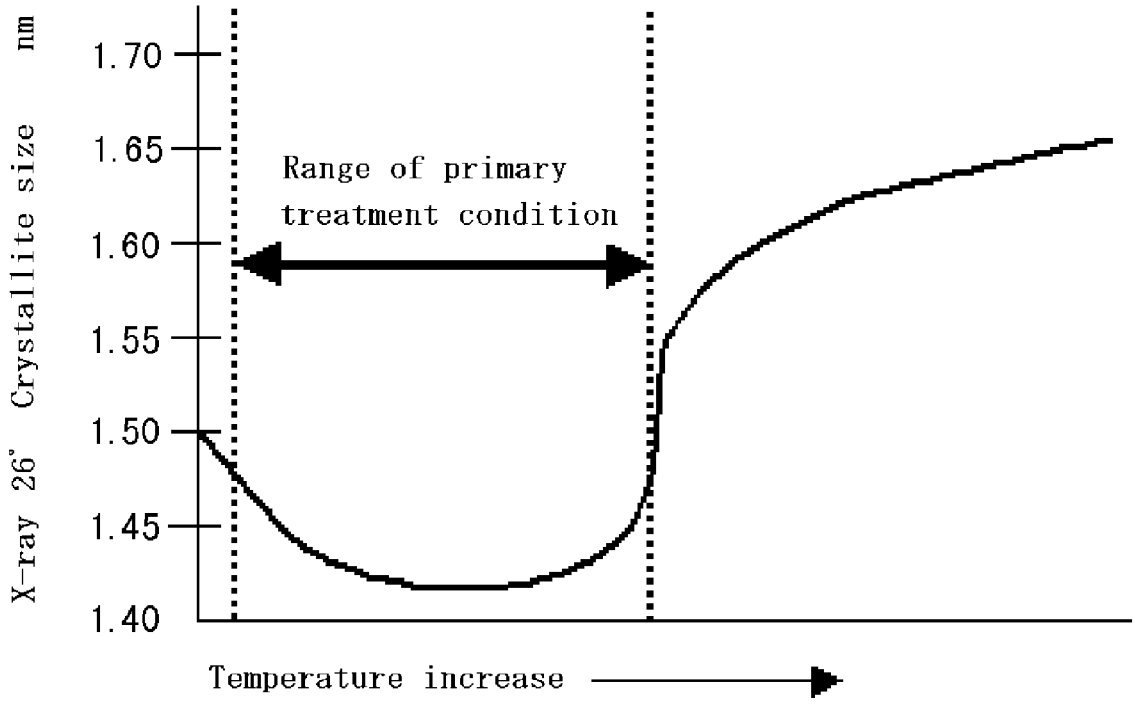
FIG. 6 is a graph showing the change of the crystallite size of a fiber subjected to a first carbonization treatment, relative to the temperature increase, in the primary stretching of second carbonization step.

The changes of density and crystallite size when measured by wide-angle X-ray diffractometry (diffraction angle: 26°), in the primary stretching treatment of second carbonization treatment step of the first carbonization treatment fiber are shown respectively in FIGS. 5 and 6.

Incidentally, in the primary stretching treatment of second carbonization treatment step, fiber tension (F MPa) depends upon the sectional area (S $mm^2$) of the fiber after first carbonization step; therefore, in the present invention, fiber stress (B mN) is used as tension factor.

In the present invention, the range of the fiber stress B lies in a range satisfying the following formula.

$$1.24>B>0.46$$

wherein $B=F\times S$ and $S=\pi D^2/4$ [D is the diameter (mm) of first carbonization treatment fiber].

Here, the fiber sectional area is calculated as follows. First, fiber diameter is measured at a repetition number n of 20 by the method using a micrometer microscope, specified by JIS R 7601. Then, an average of the measured fiber diameters is calculated. Using the calculated average of fiber diameters, an area of true circle is calculated. The calculated area of true circle is taken as fiber sectional area.

<Second Carbonization Treatment-Secondary Stretching Treatment>

Subsequently, the above-obtained primary stretching treatment fiber of second carbonization treatment step is subjected to the following secondary stretching treatment.

In the secondary stretching treatment, the primary stretching treatment fiber is stretched with temperature elevation, in a temperature elevation range in which the density of the fiber shows no change or in a temperature elevation range in which the fiber density decreases.

Figure 7:
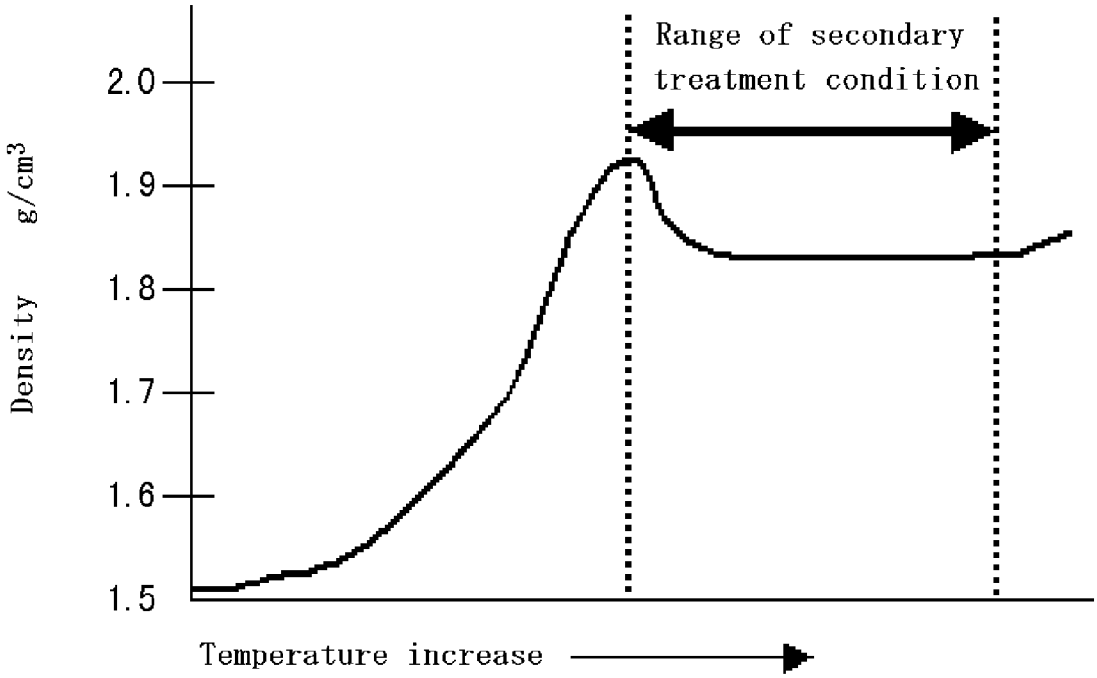
FIG. 7 is a graph showing the change of the density of a fiber subjected to the primary treatment of second carbonization step, relative to the temperature increase, in the secondary stretching of second carbonization step.

The change of the density of primary stretching treatment fiber, in its secondary stretching treatment is shown in FIG. 7.

Incidentally, in the secondary stretching treatment of second carbonization treatment step, as in the primary stretching treatment, fiber tension (H MPa) depends upon the sectional area (S $mm^2$) of the fiber after first carbonization step. In the present invention, fiber stress (E mN) is used as tension factor. The range of the fiber stress E lies in a range satisfying the following formula.

$$0.60>E>0.23$$

wherein $E=H\times S$ and $S=\pi D^2/4$ [D is the diameter (mm) of first carbonization treatment fiber].

The thus-obtained second carbonization treatment fiber has an elongation of preferably 2.10% or more, more preferably 2.20% or more. Also, the fiber preferably has a diameter of 5 to 6.5 μm.

<Third Carbonization Treatment>

In the third carbonization treatment step, the above-obtained second carbonization treatment fiber is carbonized in an inert atmosphere at 1,600 to 2,100° C. to obtain a third carbonization treatment fiber. The carbonization treatment is conducted under the following conditions.

In the third carbonization treatment step, the tension of fiber (J MPa) depends upon the sectional area (K $mm^2$) of the fiber after second carbonization treatment. In the present invention, fiber stress (G mN) is used as tension factor. In the present invention, the fiber stress needs to satisfy following formula.

$$2.80>G>0.65$$

wherein $G=J\times K$ and $K=\pi L^2/4$ [L is the diameter (mm) of second carbonization treatment fiber].

The carbonization treatment step may be conducted continuously using one carbonization treatment furnace, or may be conducted continuously using a plurality of carbonization treatment furnaces.

<Surface Treatment>

The third carbonization treatment fiber is then subjected to a surface treatment. The surface treatment includes a gas-phase treatment and a liquid-phase treatment. The surface treatment is preferred, from the standpoints of easy process control and high productivity, to be a liquid-phase treatment employing an electrolytic oxidation reaction. In the surface treatment, there is no particular restriction as to the pH of electrolytic solution; however, the pH is preferably 0 to 5.5. The oxidation reduction potential (ORP) is set at +400 mV or more, preferably at +500 mV or more.

The product of pH and ORP is controlled preferably at 0 to 2,300, more preferably at 100 or less.

As the electrolytic solution, an aqueous solution of inorganic acid, inorganic acid salt or the like can be used. However, an inorganic acid (e.g. sulfuric acid, nitric acid or hydrochloric acid) or an aqueous solution thereof is preferred and an aqueous nitric acid solution is particularly preferred.

<Sizing Treatment>

Preferably, the resulting third carbonization treatment fiber is subjected to a sizing treatment and made into a form of carbon fiber strand superior in handleability. The number of single fibers constituting the strand is preferably 500 to 40,000, more preferably 1,000 to 20,000. The sizing can be conducted by a known method. A sizing agent having a known composition can be used appropriately depending upon the application of the final carbon fiber obtained. The sizing treatment is conducted appropriately by attaching a sizing agent uniformly to the third carbonization treatment fiber, followed by drying. The drying is preferably conducted by passing the sizing agent-attached carbon fiber through an air atmosphere of 100 to 220° C.

EXAMPLES

The present invention is described more specifically by way of Examples and Comparative Examples. The testing methods for properties of precursor fiber, oxidized fiber and carbon fiber are explained below.

<Density>

The density of each fiber was measured by the Archimedes method. Each fiber was deaerated in acetone and then measured for density.

<Crystallite Size by Wide-Angle X-Ray Diffractometry (Diffraction Angle: 17° C. or 26°) and Orientation Degree>

The diffraction pattern of a fiber was obtained using an X-ray diffractometer (RINT 1200 L produced by Rigaku Denki) and a computer (Hitachi 2050/32). A crystallite size at diffraction angle of 17° or 26° was calculated from the diffraction pattern. The orientation degree of a fiber was determined using the half value width.

<Single Fiber Modulus>

A primary stretching treatment fiber of first carbonization treatment step was measured for single fiber modulus according to the method specified by JIS R 7606 (2000).

<Strand Strength and Modulus>

Each second carbonization treatment fiber and each third carbonization treatment fiber were measured for strand strength and modulus according to the method specified by JIS R 7601.

<Surface Oxygen Concentration O/C and Surface Nitrogen Concentration N/C of Carbon Fiber>

The surface oxygen concentration O/C and surface nitrogen concentration N/C of each carbon fiber were determined using XPS (ESCA) according to the following procedure.

A carbon fiber was cut. The cut fiber pieces were arranged apart on a stainless steel-made, sample support. The photoelectron escaping angle of XPS was set at 90°. An X-ray source of MgKα was used. The inside of a sample chamber was kept at a vacuum of $1\times10^{-6}$ Pa. In order to correct the peak caused by the electrification during measurement, first, the bonding energy (BE) of the main peak of $C_{1s}$ was adjusted to 284.6 eV. In the chart obtained, a linear baseline was drawn in a range of 394 to 406 eV, to determine an $N_{1s}$ peak area. An $O_{1s}$ peak area was determined by drawing a linear baseline in a range of 528 to 540 eV. A $C_{1s}$ peak area was determined by drawing a linear baseline in a range of 282 to 296 eV. A ratio of the $O_{1s}$ peak area and the $C_{1s}$ peak area was determined, and this value was taken as the surface oxygen concentration O/C of the carbon fiber. A ratio of the $N_{1s}$ peak area and the $C_{1s}$ peak area was determined, and this value was taken as the surface nitrogen concentration N/C of the carbon fiber.

<Band Intensity Ratio (D/G)>

As a Raman spectrometer, there was used Single Microscope Laser Raman Spectrometer T 64000 produced by JOBIN YVON Corporation. As an excitation light source, an $Ar^+$ laser (λ=514.5 nm) was used. The output of the $Ar^+$ laser was 20 mW. Baseline correction was made for the chart obtained, after which a 1360 $cm^{-1}$ band intensity (D) and a 1580 $cm^{-1}$ band intensity (G) were calculated. Using these intensities, a band intensity ratio (D/G) was calculated. The same measurement were repeated three times and an average of three measurements was determined. This average was taken as the band intensity ratio (D/G) of the material measured.

<Shape of Carbon Fiber>

The striation roughness (height difference between mountain and valley) and surface roughness in very small surface area, formed on the surface of a carbon fiber are each determined as root mean square surface roughness. For these measurements, a scanning probe microscope (SPM Nanoscope III produced by DI) was used. A carbon fiber sample to be examined was put on a stainless steel-made disc for measurement; the two ends of the sample were fixed; and measurement was conducted in Tapping Mode.

The data obtained was subjected to secondary curve correction using a program attached to the scanning probe microscope and a root mean square surface roughness was determined.

As to the distance between striations (distance between mountains in wave shape), of a carbon fiber, a surface area of 2×2 μm was observed using the same scanning probe microscope, and the distance between striations was measured from the image obtained. The same measurement was repeated five times, an average was calculated, and the average was taken as distance between striations.

Example 1

A spinning solution of a copolymer composed of 95 mass % of acrylonitrile, 4 mass % of methyl acrylate and 1 mass % of itaconic acid was subjected to wet spinning, followed by water washing, drying, drawing and oiling, to obtain an acrylic precursor fiber having a fiber diameter of 9.1 μm and an orientation degree of 89.7% when measured by wide-angle X-ray diffractometry (diffraction angle: 17°). This fiber was subjected to an oxidation treatment in hot air in an oxidation furnace of hot-air circulation type, of inlet temperature (minimum temperature) of 200° C. and outlet temperature (maximum temperature) of 260° C., to obtain an acrylic oxidized fiber having a fiber density of 1.34 g/cm$^3$ and a mass reduction ratio of 5.0% when immersed in DMF for 12 hours.

Then, the oxidized fiber was subjected to primary and secondary stretching treatments using a first carbonization furnace, under the conditions shown in Table 1. The first carbonization furnace contained inside an inert atmosphere and had an inlet temperature (minimum temperature) of 300° C. and an outlet temperature (maximum temperature) of 800° C. The inside of the carbonization furnace had such a temperature gradient that the inside temperature became gradually higher from the inlet toward the outlet.

The primary stretching was conducted in a range β shown in FIG. 2 at a stretching ratio of 1.05 times. The fiber after the primary stretching treatment (primary stretching treatment fiber) had a single fiber modulus of 8.8 GPa, a density of 1.40 g/cm$^3$ and a crystallite size of 1.20 nm and showed no end breakage.

Figure 3:
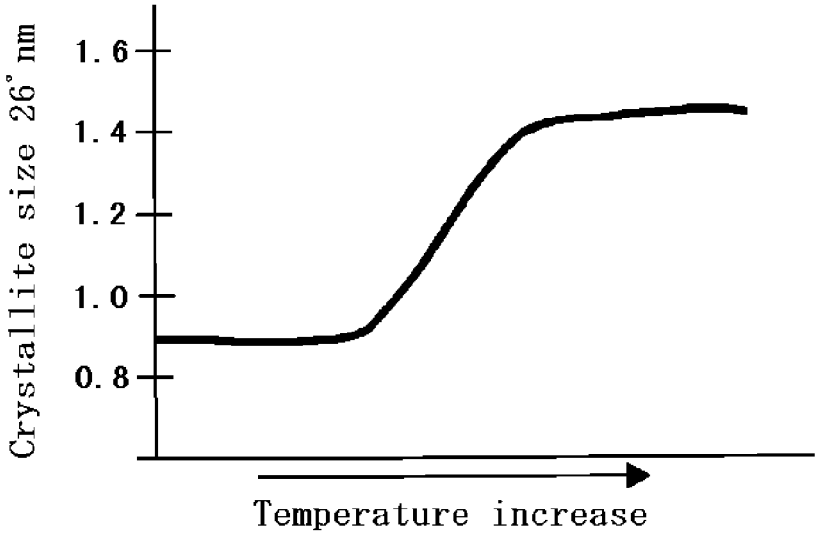
FIG. 3 is a graph showing the change of the crystallite size of a PAN-based oxidized fiber, relative to the temperature increase, in the primary stretching of first carbonization step.

Then, the primary stretching treatment fiber was subjected to secondary stretching of first carbonization step. The secondary stretching was carried out in a temperature elevation range in which the density of the fiber continued to increase (FIG. 4) and the crystallite size thereof was not larger than 1.45 nm (FIG. 3). The stretching ratio was 1.00 time. By the secondary stretching treatment, there was obtained a first carbonization treatment fiber having a density of 1.70 g/cm$^3$, an orientation degree of 79.0%, a fiber diameter of 5.9 μm and a fiber sectional area of $2.73\times10^{-5}$ mm$^2$. The first carbonization treatment fiber shows no end breakage.

Then, the first carbonization treatment fiber was subjected to primary and secondary stretching treatments using a second carbonization furnace, step under the following conditions. The second carbonization furnace contained inside an inert atmosphere and had an inlet temperature (minimum temperature) of 800° C. and an outlet temperature (maximum temperature) of 1,550° C. The inside of the carbonization furnace had such a temperature gradient that the inside temperature became gradually higher from the inlet toward the outlet.

First, the first carbonization treatment fiber was subjected to primary stretching at a fiber tension of 29.9 MPa and a fiber stress of 0.817 mN while the density and crystallite size of the fiber were respectively in primary stretching treatment condition ranges of FIG. 5 and FIG. 6, to obtain a primary treatment fiber. That is, as shown in FIG. 5, stretching was conducted in a period in which the density of the fiber increased with temperature elevation and reached the maximum 1.9 g/cm$^3$. Further, as shown in FIG. 6, stretching was conducted in a period in which the crystallite size of the fiber decreased once with temperature elevation, then began to increase and reached 1.47 nm.

Then, the primary stretching treatment fiber was subjected to secondary stretching treatment of second carbonization step. The secondary stretching treatment was conducted at a fiber tension of 14.9 MPa at a fiber stress of 0.408 mN under a density range shown in FIG. 7, to obtain a second carbonization treatment fiber.

The fiber had a diameter of 5.2 μm, a sectional area of $2.12\times10^{-5}$ mm$^2$, a density of 1.805 g/cm$^3$ and an elongation of 2.20%.

Then, the second carbonization treatment fiber was subjected to a third carbonization treatment using a third carbonization furnace. The third carbonization furnace contained inside an inert atmosphere and had an inlet temperature (minimum temperature) of 1,600° C. and an outlet temperature (maximum temperature) of 1,900° C. In the third carbonization treatment, stretching was conducted at a fiber tension of 76.9 MPa and a fiber stress of 1.633 mN and a third carbonization treatment fiber was obtained.

Then, the third carbonization treatment fiber was subjected to a surface treatment by an electrolytic oxidation reaction using an electrolytic solution (an aqueous nitric acid solution) in which the pH was set at 0.1, the oxidation reduction potential (ORP) was set at +600 mV and the product of pH and ORP was set at 60.

Subsequently, a sizing agent was applied to the third carbonization treatment fiber by a known method, followed by drying, to obtain a carbon fiber strand having a density of 1.77 g/cm$^3$, a fiber diameter of 5.1 μm, a strand strength of 6,130 MPa, a strand modulus of 343 GPa, an orientation of 84.2% and a crystallite size of 2.2 nm.

In the fiber, striations were observed on the surface; the distance between striations was 0.20 μm; the striation roughness Rms (5μ) was 25.0 nm; the surface roughness Rms (0.5μ) was 6.2 nm; the surface oxygen concentration (O/C) was 0.14; the surface nitrogen concentration (N/C) was 0.025; and the band intensity ratio (D/G) was 1.293. This carbon fiber had properties suitable as a carbon fiber for use in production of composite material.

Examples 2 to 3 and Comparative Examples 1 to 14

The oxidized fiber obtained in Example 1 was subjected to a first carbonization treatment, a second carbonization treatment, a third carbonization treatment, a surface treatment and a sizing treatment, in the same manners as in Example 1 except that the treatments were conducted under the conditions shown in Tables 1 to 6, whereby were obtained carbon fibers after first carbonization treatment, second carbonization treatment, third carbonization treatment, surface treatment and sizing treatment, having properties shown in Tables 1 to 6.

However, in Comparative Examples 4 and 10, the steps after second carbonization step could not be run and, in Comparative Examples 5 and 6, the steps after first carbonization secondary stretching treatment step could not be run.

As shown in Table 1, the carbon fibers obtained in Examples 2 to 3, similarly to the carbon fiber obtained in Example 1, showed properties suitable as a carbon fiber for composite material. In contrast, in Comparative Examples 1 to 3, 7 to 9 and 11 to 14, the carbon fibers shown in Tables 1 to 6 were obtained but showed properties insufficient as a carbon fiber for composite material.

Examples 4 and Comparative Examples 15 to 16

The second carbonization fiber obtained in Example 1 was subjected to a third carbonization treatment, a surface treatment and a sizing treatment in the same manners as in Example 1 except that the third carbonization treatment was conducted under a temperature condition shown in Table 7, whereby carbon fibers after surface treatment and sizing treatment, having properties shown in Table 7 were obtained.

As a result, the carbon fiber obtained in Example 4, similarly to that of Example 1, showed properties suitable as a carbon fiber for composite material, as shown in Table 7. In contrast, the carbon fibers obtained in Comparative Examples 15 to 16 showed no properties sufficient as a carbon fiber for composite material, as shown in Table 7.

Examples 5 to 8 and Comparative Examples 17 to 23

The third carbonization fiber obtained in Example 1 was subjected to a surface treatment and a sizing treatment in the same manners as in Example 1 except that the surface treatment was conducted under conditions shown in Tables 8 to 10, whereby carbon fibers after surface treatment and sizing treatment, having properties shown in Tables 8 to 10 were obtained.

The carbon fibers obtained in Examples 5 to 8, similarly to that of Example 1, showed properties suitable as a carbon fiber for composite material, as shown in Tables 8 to 10. In contrast, the carbon fibers obtained in Comparative Examples 17 to 23 showed properties insufficient as a carbon fiber for composite material, as shown in Tables 8 to 10.

TABLE 1

| | | | Example 1 | Example 2 | Example 3 |
|---|---|---|---|---|---|
| Precursor fiber | | Orientation degree (%) | 89.7 | 89.7 | 89.7 |
| Oxidized fiber | | Density (g/cm$^3$) | 1.34 | 1.34 | 1.34 |
| | | Mass reduction by DMF (%) | 5.0 | 5.0 | 5.0 |
| First carbonization step | Primary stretching conditions | Range of FIG. 1 | β | β | β |
| | | Stretching ratio (times) | 1.05 | 1.06 | 1.05 |
| | | Single fiber modulus (GPa) | 8.8 | 8.4 | 8.8 |
| | | Density (g/cm$^3$) | 1.40 | 1.39 | 1.40 |
| | | Crystallite size (nm) | 1.20 | 1.10 | 1.20 |
| | Secondary stretching conditions | Change of density | Continuous increase | Continuous increase | Continuous increase |
| | | Crystallite size (nm) | 1.45 or less | 1.45 or less | 1.45 or less |
| | | Stretching ratio (times) | 1.00 | 1.01 | 1.00 |
| After first carbonization | | Density (g/cm$^3$) | 1.70 | 1.75 | 1.52 |
| | | Orientation degree (%) | 79.0 | 79.5 | 77.0 |
| | | Fiber diameter (μm) | 5.9 | 5.5 | 6.8 |
| Second carbonization step | Primary treatment | Fiber tension F (MPa) | 29.9 | 44.7 | 18.0 |
| | | Fiber stress B (mN) | 0.817 | 1.062 | 0.653 |
| | Secondary treatment | Fiber tension H (MPa) | 14.9 | 15.5 | 11.2 |
| | | Fiber stress B (mN) | 0.408 | 0.368 | 0.408 |
| After second carbonization | | Density (g/cm$^3$) | 1.805 | 1.810 | 1.800 |
| | | Fiber diameter (μm) | 5.2 | 5.1 | 5.2 |
| | | Elongation (%) | 2.21 | 2.23 | 2.20 |
| Third carbonization step | | Fiber tension J (MPa) | 76.9 | 80.0 | 76.9 |
| | | Fiber stress G (mN) | 1.633 | 1.633 | 1.633 |
| Carbon fiber | | Strand form | Good | Good | Good |
| | | Density (g/cm$^3$) | 1.77 | 1.79 | 1.76 |
| | | Fiber diameter (μm) | 5.1 | 5.0 | 5.1 |
| | | Strand strength (MPa) | 6150 | 6200 | 6100 |
| | | Strand modulus (GPa) | 343 | 345 | 342 |
| | | Orientation degree (%) | 84.2 | 84.3 | 84.2 |
| | | Crystallite size (nm) | 2.2 | 2.2 | 2.2 |
| | | Presence of surface striations | Yes | Yes | Yes |
| | | Distance between striations (μm) | 0.20 | 0.20 | 0.20 |
| | | Striation roughness Rms (5 μ) (nm) | 25.0 | 26.0 | 25.5 |
| | | Surface roughness Rms (0.5 μ) (nm) | 6.2 | 6.0 | 6.5 |
| | | Surface oxygen concentration (O/C) | 0.14 | 0.14 | 0.14 |
| | | Surface nitrogen concentration (N/C) | 0.025 | 0.022 | 0.026 |
| | | Band intensity ratio (D/G) | 1.293 | 1.295 | 1.294 |

TABLE 2

| | | | Comparative Example 1 | Comparative Example 2 | Comparative Example 3 |
|---|---|---|---|---|---|
| Precursor fiber | | Orientation degree (%) | 89.7 | 89.7 | 89.7 |
| Oxidized fiber | | Density (g/cm$^3$) | 1.34 | 1.34 | 1.34 |
| | | Mass reduction by DMF (%) | 5.0 | 5.0 | 5.0 |
| First carbonization step | Primary stretching conditions | Range of FIG. 1 | β | β | β |
| | | Stretching ratio (times) | 1.05 | 1.05 | 1.06 |
| | | Single fiber modulus (GPa) | 8.8 | 8.8 | 8.8 |
| | | Density (g/cm$^3$) | 1.40 | 1.40 | 1.40 |
| | | Crystallite size (nm) | 1.20 | 1.20 | 1.20 |
| | Secondary stretching Conditions | Change of density | Continuous increase | Continuous increase | Continuous increase |
| | | Crystallite size (nm) | 1.45 or less | 1.45 or less | 1.45 or less |
| | | Stretching ratio (times) | 1.00 | 1.00 | 1.01 |

TABLE 2-continued

| | | | Comparative Example 1 | Comparative Example 2 | Comparative Example 3 |
|---|---|---|---|---|---|
| After first carbonization | | Density (g/cm$^3$) | 1.70 | 1.70 | 1.70 |
| | | Orientation degree (%) | 79.0 | 79.0 | 79.0 |
| | | Fiber diameter (μm) | 5.9 | 5.9 | 5.9 |
| Second carbonization step | Primary treatment | Fiber tension F (MPa) | 50.8 | 14.9 | 29.9 |
| | | Fiber stress B (mN) | 1.388 | 0.408 | 0.817 |
| | Secondary treatment | Fiber tension H (MPa) | 14.9 | 14.9 | 23.9 |
| | | Fiber stress E (mN) | 0.408 | 0.408 | 0.653 |
| After second carbonization step | | Density (g/cm$^3$) | 1.795 | 1.800 | 1.800 |
| | | Fiber diameter (μm) | 5.1 | 5.3 | 5.0 |
| | | Elongation (%) | 2.10 | 2.10 | 2.15 |
| Third carbonization step | | Fiber tension J (MPa) | 80.0 | 74.0 | 83.2 |
| | | Fiber stress G (mN) | 1.633 | 1.633 | 1.633 |
| Carbon fiber | | Strand form | Good | Good | Good |
| | | Density (g/cm$^3$) | 1.75 | 1.76 | 1.76 |
| | | Fiber diameter (μm) | 5.0 | 5.2 | 5.1 |
| | | Strand strength (MPa) | 5900 | 6000 | 5950 |
| | | Strand modulus (GPa) | 342 | 341 | 345 |
| | | Orientation degree (%) | 84.2 | 84.1 | 84.3 |
| | | Crystallite size (nm) | 2.2 | 2.2 | 2.2 |
| | | Presence of surface striations | Yes | Yes | Yes |
| | | Distance between striations (μm) | 0.21 | 0.22 | 0.21 |
| | | Striation roughness Rms (5 μ) (nm) | 26.0 | 25.5 | 27.0 |
| | | Surface roughness Rms (0.5 μ) (nm) | 7.0 | 6.5 | 6.5 |
| | | Surface oxygen concentration (O/C) | 0.14 | 0.14 | 0.14 |
| | | Surface nitrogen concentration (N/C) | 0.023 | 0.024 | 0.022 |
| | | Band intensity ratio (D/G) | 1.297 | 1.293 | 1.290 |

TABLE 3

| | | | Comparative Example 4 | Comparative Example 5 | Comparative Example 6 |
|---|---|---|---|---|---|
| Precursor fiber | | Orientation degree (%) | 89.7 | 89.7 | 89.7 |
| Oxidized fiber | | Density (g/cm$^3$) | 1.34 | 1.34 | 1.34 |
| | | Mass reduction by DMF (%) | 5.0 | 5.0 | 5.0 |
| First carbonization step | Primary stretching conditions | Range of FIG. 1 | β | α | Y |
| | | Stretching ratio (times) | 1.05 | 1.05 | 1.05 |
| | | Single fiber modulus (GPa) | 8.8 | 9.2 | 10.3 |
| | | Density (g/cm$^3$) | 1.40 | 1.37 | 1.52 |
| | | Crystallite size (nm) | 1.20 | 0.90 | 1.45 |
| | Secondary stretching Conditions | Change of density | Continuous increase | No passing trough step | No passing through step |
| | | Crystallite size (nm) | 1.45 or less | | |
| | | Stretching ratio (times) | 1.00 | | |
| After first carbonization | | Density (g/cm$^3$) | 1.70 | | |
| | | Orientation degree (%) | 79.0 | | |
| | | Fiber diameter (μm) | 5.9 | | |
| Second carbonization step | Primary treatment | Fiber tension F (MPa) | 29.9 | | |
| | | Fiber stress B (mN) | 0.817 | | |
| | Secondary treatment | Fiber tension H (MPa) | 6.0 | | |
| | | Fiber stress E (mN) | 0.163 | | |
| After second carbonization | | Density (g/cm$^3$) | 1.805 | | |
| | | Fiber diameter (μm) | 5.2 | | |
| | | Elongation (%) | 2.20 | | |
| Third carbonization step | | Fiber tension J (MPa) | No passing through step | | |
| | | Fiber stress G (mN) | | | |
| Carbon Fiber | | Strand form | | | |
| | | Density (g/cm$^3$) | | | |
| | | Fiber diameter (μm) | | | |
| | | Strand strength (MPa) | | | |
| | | Strand modulus (GPa) | | | |
| | | Orientation degree (%) | | | |
| | | Crystallite size (nm) | | | |
| | | Presence of surface striations | | | |

TABLE 3-continued

| | | | Comparative Example 4 | Comparative Example 5 | Comparative Example 6 |
|---|---|---|---|---|---|
| | | Distance between striations (μm) | | | |
| | | Striation roughness Rms (5 μ) (nm) | | | |
| | | Surface roughness Rms (0.5 μ) (nm) | | | |
| | | Surface oxygen concentration (0/C) | | | |
| | | Surface nitrogen concentration (N/C) | | | |
| | | Band intensity ratio (D/G) | | | |

TABLE 4

| | | | Comparative Example 7 | Comparative Example 8 | Comparative Example 9 |
|---|---|---|---|---|---|
| Precursor fiber | | Orientation degree (%) | 89.7 | 89.7 | 89.7 |
| Oxidized fiber | | Density (g/cm$^3$) | 1.34 | 1.34 | 1.34 |
| | | Mass reduction by DMF (%) | 5.0 | 5.0 | 5.0 |
| First carbonization step | Primary stretching conditions | Range of FIG. 1 | β | β | β |
| | | Stretching ratio (times) | 1.06 | 1.05 | 1.02 |
| | | Single fiber modulus (GPa) | 8.8 | 8.8 | 8.8 |
| | | Density (g/cm$^3$) | 1.40 | 1.40 | 1.38 |
| | | Crystallite size (nm) | 1.20 | 1.20 | 1.20 |
| | Secondary stretching Conditions | Change of density | Increase and then decrease | No increase | Continuous increase |
| | | Crystallite size (nm) | 1.47 | 1.45 or less | 1.45 or less |
| | | Stretching ratio (times) | 1.00 | 1.00 | 1.00 |
| After first carbonization | | Density (g/cm$^3$) | 1.80 | 1.50 | 1.63 |
| | | Orientation degree (%) | 79.8 | 76.5 | 77.5 |
| | | Fiber diameter (μm) | 5.4 | 6.9 | 6.1 |
| Second carbonization step | Primary treatment | Fiber tension F (MPa) | 35.7 | 21.8 | 27.9 |
| | | Fiber stress B (mN) 0.817 | 0.817 | 0.817 | |
| | Secondary treatment | Fiber tension H (MPa) | 17.8 | 10.9 | 14.0 |
| | | Fiber stress B (mN) | 0.408 | 0.408 | 0.408 |
| After second carbonization | | Density (g/cm$^3$) | 1.790 | 1.802 | 1.798 |
| | | Fiber diameter (μm) | 5.0 | 5.0 | 5.2 |
| | | Elongation (%) | 2.05 | 2.15 | 2.20 |
| Third carbonization step | | Fiber tension J (MPa) | 83.2 | 83.2 | 76.9 |
| | | Fiber stress G (mN) | 1.633 | 1.633 | 1.633 |
| Carbon Fiber | | Strand form | Good | Good | Good |
| | | Density (g/cm$^3$) | 1.74 | 1.76 | 1.76 |
| | | Fiber diameter (μm) | 4.9 | 4.9 | 5.1 |
| | | Strand strength (MPa) | 5800 | 5950 | 5850 |
| | | Strand modulus (GPa) | 338 | 343 | 336 |
| | | Orientation degree (%) | 84.0 | 84.2 | 83.9 |
| | | Crystallite size (nm) | 2.2 | 2.2 | 2.1 |
| | | Presence of surface striations | Yes | Yes | Yes |
| | | Distance between striations (μm) | 0.19 | 0.20 | 0.21 |
| | | Striation roughness Rms (5 μ) (nm) | 24.0 | 25.0 | 26.0 |
| | | Surface roughness Rms (0.5 μ) (nm) | 6.6 | 6.3 | 6.0 |
| | | Surface oxygen concentration (O/C) | 0.15 | 0.14 | 0.15 |
| | | Surface nitrogen concentration (N/C) | 0.026 | 0.023 | 0.022 |
| | | Band intensity ratio (D/G) | 1.293 | 1.294 | 1.299 |

TABLE 5

| | | | Comparative Example 10 | Comparative Example 11 | Comparative Example 12 |
|---|---|---|---|---|---|
| Precursor fiber | | Orientation degree (%) | 89.7 | 89.7 | 89.7 |
| Oxidized fiber | | Density (g/cm$^3$) | 1.34 | 1.34 | 1.34 |
| | | Mass reduction by DMF (%) | 5.0 | 5.0 | 5.0 |
| First carbonization step | Primary stretching conditions | Range of FIG. 1 | β | β | β |
| | | Stretching ratio (times) | 1.07 | 1.05 | 1.05 |
| | | Single fiber modulus (GPa) | 8.8 | 8.8 | 8.8 |
| | | Density (g/cm$^3$) | 1.39 | 1.39 | 1.39 |
| | | Crystallite size (nm) | 1.20 | 1.20 | 1.20 |
| | Secondary stretching conditions | Change of density | Continuous increase | Continuous increase | Continuous increase |
| | | Crystallite size (nm) | 1.45 or less | 1.45 or less | 1.45 or less |
| | | Stretching ratio (times) | 1.00 | 0.85 | 1.03 |

TABLE 5-continued

| | | | Comparative Example 10 | Comparative Example 11 | Comparative Example 12 |
|---|---|---|---|---|---|
| After first carbonization | | Density (g/cm$^3$) | 1.68 | 1.71 | 1.70 |
| | | Orientation degree (%) | 79.1 | 78.5 | 79.2 |
| | | Fiber diameter (μm) | 5.7 | 6.0 | 5.8 |
| Second carbonization step | Primary treatment | Fibertension F(MPa) | 32.0 | 28.9 | 30.9 |
| | | Fiber stressB (mN) | 0.817 | 0.817 | 0.817 |
| | Secondary treatment | FibertensionH(MPa) | 16.0 | 14.4 | 15.5 |
| | | Fiber stressB (mN) | 0.408 | 0.408 | 0.408 |
| After second carbonization | | Density (g/cm$^3$) | 1.795 | 1.800 | 1.790 |
| | | Fiber diameter (μm) | 4.9 | 5.2 | 4.9 |
| | | Elongation (%) | 2.20 | 2.05 | 2.10 |
| Third carbonization step | | Fiber tension J (MPa) | No passing through step | 76.9 | 86.6 |
| | | Fiber stress G (mN) | | 1.633 | 1.633 |
| Carbon fiber | | Strand form | | Good | Good |
| | | Density (g/cm$^3$) | | 1.76 | 1.74 |
| | | Fiber diameter (μm) | | 5.1 | 4.8 |
| | | Strand strength (MPa) | | 5750 | 5500 |
| | | Strand modulus (GPa) | | 335 | 336 |
| | | Orientation degree (%) | | 83.8 | 83.9 |
| | | Crystallite size (nm) | | 2.1 | 2.2 |
| | | Presence of surface striations | | Yes | Yes |
| | | Distance between striations (μm) | | 0.21 | 0.19 |
| | | Striation roughness Rms (5 μ) (nm) | | 26.0 | 23.5 |
| | | Surface roughness Rms (0.5 μ) (nm) | | 6.9 | 7.5 |
| | | Surface oxygen concentration (O/C) | | 0.14 | 0.14 |
| | | Surface nitrogen concentration (N/C) | | 0.024 | 0.023 |
| | | Band intensity ratio (D/G) | | 1.299 | 1.298 |

TABLE 6

| | | | Comparative Example 13 | Comparative Example 14 |
|---|---|---|---|---|
| Precursor fiber | | Orientation degree (%) | 89.7 | 89.7 |
| Oxidized fiber | | Density (g/cm$^3$) | 1.34 | 1.34 |
| | | Mass reduction by DMF (%) | 5.0 | 5.0 |
| First carbonization step | Primary stretching conditions | Range of FIG. 1 | β | β |
| | | Stretching ratio (times) | 1.05 | 1.05 |
| | | Single fiber modulus (GPa) | 8.8 | 8.8 |
| | | Density (g/cm$^3$) | 1.40 | 1.40 |
| | | Crystallite size (nm) | 1.20 | 1.20 |
| | Secondary stretching conditions | Change of density | Continuous increase | Continuous increase |
| | | Crystallite size (nm) | 1.45 orless | 1.45 orless |
| | | Stretching ratio (times) | 1.00 | 1.00 |
| After first carbonization | | Density (g/cm$^3$) | 1.70 | 1.70 |
| | | Orientation degree (%) | 79.0 | 79.0 |
| | | Fiber diameter (μm) | 5.9 | 5.9 |
| Second carbonization step | Primary treatment | Fiber tension F (MPa) | 29.9 | 29.9 |
| | | Fiber stress B (mN) | 0.817 | 0.817 |
| | Secondary treatment | Fiber tension H (MPa) | 14.9 | 14.9 |
| | | Fiber stress E (mN) | 0.408 | 0.408 |
| After second carbonization | | Density (g/cm$^3$) | 1.805 | 1.805 |
| | | Fiber diameter (μm) | 5.2 | 5.2 |
| | | Elongation (%) | 2.21 | 2.21 |
| Third carbonization step | | Fiber tension J (MPa) | 26.9 | 153.8 |
| | | Fiber stress G (mN) | 0.572 | 3.267 |
| Carbon Fiber | | Strand form | Good | Bad |
| | | Density (g/cm$^3$) | 1.76 | 1.75 |
| | | Fiber diameter (μm) | 5.2 | 4.9 |
| | | Strand strength (MPa) | 6050 | 5850 |
| | | Strand modulus (GPa) | 340 | 348 |
| | | Orientation degree (%) | 84.1 | 84.4 |
| | | Crystallite size (nm) | 2.2 | 2.2 |
| | | Presence of surface striations | Yes | Yes |

TABLE 6-continued

| | Comparative Example 13 | Comparative Example 14 |
|---|---|---|
| Distance between striations (μm) | 0.20 | 0.20 |
| Striation roughness Rms (5 μ) (nm) | 24.5 | 26.5 |
| Surface roughness Rms (0.5 μ) (nm) | 6.3 | 7.0 |
| Surface oxygen concentration (O/C) | 0.14 | 0.14 |
| Surface nitrogen concentration (N/C) | 0.025 | 0.028 |
| Band intensity ratio (D/C) | 1.293 | 1.290 |

TABLE 7

| | | Comparative Example 15 | Example 1 | Example 4 | Comparative Example 16 |
|---|---|---|---|---|---|
| Maximum temperature in third carbonizarion step (° C.) | | 1800 | 1900 | 2000 | 2100 |
| Carbon fiber | Strand form | Good | Good | Good | Good |
| | Density (g/cm$^3$) | 1.79 | 1.77 | 1.76 | 1.79 |
| | Fiber diameter (μm) | 5.2 | 5.1 | 5.1 | 5.0 |
| | Strand strength (MPa) | 6250 | 6150 | 6100 | 5850 |
| | Strand modulus (GPa) | 325 | 343 | 360 | 381 |
| | Orientation degree (%) | 83.5 | 84.2 | 85.0 | 85.6 |
| | Crystallite size (nm) | 2.1 | 2.2 | 2.4 | 2.6 |
| | Presence of surface striations | Yes | Yes | Yes | Yes |
| | Distance between striations (μm) | 0.22 | 0.20 | 0.20 | 0.19 |
| | Striation roughness Rms (5 μ) (nm) | 27.0 | 25.0 | 23.0 | 21.5 |
| | Surface roughness Rms (0.5 μ) (nm) | 7.5 | 6.2 | 8.0 | 9.0 |
| | Surface oxygen concentration (O/C) | 0.16 | 0.14 | 0.13 | 0.12 |
| | Surface nitrogen concentration (N/C) | 0.038 | 0.025 | 0.018 | 0.010 |
| | Band intensity ratio (D/G) | 1.31 | 1.293 | 1.130 | 1.005 |

TABLE 8

| | | Example 1 | Comparative Example 17 | Comparative Example 18 | Comparative Example 19 |
|---|---|---|---|---|---|
| Surface treatment conditions | PH | 0.1 | 0.1 | 0.1 | 0.1 |
| | ORP (mV) | +600 | +600 | +600 | +600 |
| | PH × ORP | 60 | 60 | 60 | 60 |
| | Kind of chemical | Nitric acid | Nitric acid | Nitric acid | Nitric acid |
| | Electricity amount for surface treatment (C/g) | 200 | 0 | 50 | 100 |
| Carbon fiber | Strand form | Good | Good | Good | Good |
| | Density (g/cm$^3$) | 1.77 | 1.77 | 1.77 | 1.77 |
| | Fiber diameter (μm) | 5.1 | 5.1 | 5.1 | 5.1 |
| | Strand strength (MPa) | 6150 | 5650 | 5850 | 6000 |
| | Strand modulus (GPa) | 343 | 345 | 345 | 344 |
| | Orientation degree (%) | 84.2 | 84.3 | 84.2 | 84.2 |
| | Crystallite size (nm) | 2.2 | 2.2 | 2.2 | 2.2 |
| | Presence of surface striations | Yes | Yes | Yes | Yes |
| | Distance between striations (μm) | 0.20 | 0.14 | 0.14 | 0.23 |
| | Striation roughness Rms (5 μ) (nm) | 25.0 | 11.0 | 16.621.7 | |
| | Surface roughness Rms (0.5 μ) (nm) | 6.2 | 2.0 | 4.8 | 5.4 |
| | Surface oxygen concentration (O/C) | 0.14 | 0.05 | 0.08 | 0.10 |
| | Surface nitrogen concentration (N/C) | 0.025 | 0.033 | 0.031 | 0.043 |
| | Band intensity ratio (D/G) | 1.293 | 0.916 | 1.211 | 1.248 |

TABLE 9

| | | Example 5 | Example 6 | Example 7 | Comparative Example 20 |
|---|---|---|---|---|---|
| Surface treatment conditions | PH | 0.1 | 0.1 | 0.1 | 0.1 |
| | ORP (mV) | +600 | +600 | +600 | +600 |
| | PH x ORP | 60 | 60 | 60 | 60 |
| | Kind of chemical | Nitric acid | Nitric acid | Nitric acid | Nitric acid |
| | Electricity amount for surface treatment (c/g) | 150 | 250 | 300 | 350 |
| Carbon fiber | Strand form | Good | Good | Good | Good |
| | Density (g/cm$^3$) | 1.77 | 1.77 | 1.77 | 1.77 |
| | Fiber diameter (μm) | 5.1 | 5.1 | 5.0 | 5.0 |
| | Strand strength (MPa) | 6100 | 6300 | 6250 | 6000 |
| | Strand modulus (GPa) | 344 | 343 | 343 | 342 |
| | Orientation degree (%) | 84.2 | 84.3 | 84.4 | 84.4 |
| | Crystallite size (nm) | 2.2 | 2.2 | 2.2 | 2.2 |
| | Presence of surface striations | Yes | Yes | Yes | Yes |
| | Distance between striations (μm) | 0.21 | 0.23 | 0.25 | 0.27 |
| | Striation roughness Rms (5 μ) (nm) | 22.5 | 34.5 | 37.4 | 41.0 |
| | Surface roughness Rms (0.5 μ) (nm) | 9.9 | 4.3 | 8.7 | 12.1 |
| | Surface oxygen concentration (O/C) | 0.13 | 0.14 | 0.15 | 0.16 |
| | Surface nitrogen concentration (N/C) | 0.042 | 0.036 | 0.021 | 0.02 |
| | Band intensity ratio (D/G) | 1.296 | 1.294 | 1.300 | 1.305 |

TABLE 10

| | | Comparative Example 21 | Example 8 | Comparative Example 22 | Comparative Example 23 |
|---|---|---|---|---|---|
| Surface treatment conditions | PH | 5.5 | 0.1 | 5.5 | 10 |
| | ORP (my) | +400 | +600 | +300 | +200 |
| | PH x ORP | 2200 | 60 | 1650 | 2000 |
| | Kind of chemical | Ammonium nitrate | Sulfuric acid | Ammnonium sulfate | Ammonium hydrogen carbonate |
| | Electricity amount for surface treatment (C/g) | 150 | 150 | 150 | 150 |
| Carbon fiber | Strand form | Good | Good | Good | Good |
| | Density (g/cm$^3$) | 1.77 | 1.79 | 1.76 | 1.75 |
| | Fiber diameter (μm) | 5.1 | 5.1 | 5.1 | 5.1 |
| | Strand strength (MPa) | 5950 | 6100 | 5800 | 5700 |
| | Strand modulus (GPa) | 344 | 343 | 341 | 339 |
| | Orientation degree (%) | 84.3 | 84.3 | 84.4 | 84.4 |
| | Crystallite size (nm) | 2.2 | 2.2 | 2.2 | 2.2 |
| | Presence of surface striations | Yes | Yes | Yes | Yes |
| | Distance between striations (μm) | 0.18 | 0.20 | 0.16 | 0.14 |
| | Striation roughness Rms (5 μ) (nm) | 20.5 | 23.5 | 16.0 | 13.0 |
| | Surface roughness Rms (0.5 μ) (nm) | 6.8 | 8.7 | 3.8 | 2.5 |
| | Surface oxygen concentration (O/C) | 0.14 | 0.13 | 0.13 | 0.10 |
| | Surface nitrogen concentration (N/C) | 0.028 | 0.03 | 0.032 | 0.031 |
| | Band intensity ratio (D/G) | 1.250 | 1.293 | 1.158 | 1.09 |

The invention claimed is:

1. A carbon fiber having a strand tensile strength of 6,100-6,400 MPa, a strand tensile modulus of 340-370 GPa, an average diameter of the carbon fiber of 4.5 to 6.0 μm and a density of 1.76-1.80 g/cm$^3$ and possessing, on the surface, striations oriented in a direction parallel to the fiber axis, wherein the distance between striations in a 2×2 μm area of the carbon fiber surface when observed by a scanning probe microscope is 0.1 to 0.3 μm, the root mean square surface roughness Rms (5 μm) in a 5×5 μm area of the carbon fiber surface when observed by a scanning probe microscope is 20 to 40 nm, and the root mean square surface roughness Rms (0.5 μm) when measured in a 0.5×0.5 μm area is 2 to 12 nm.

2. The carbon fiber according to claim 1, wherein the surface oxygen concentration (O/C) of carbon fiber when measured by an X-ray photoelectron spectrometer is 0.13 or more, the surface nitrogen concentration (N/C) of carbon fiber when measured by the spectrometer is 0.05 or less, the crystallite size measured by wide-angle X-ray diffractometry is 2 nm or more, and the band intensity ratio (DIG) of 1,360 $cm^{-1}$ band intensity (D) and 1,580 $cm^{-1}$ band intensity (G) when measured by Raman spectrometry is 1.3 or less.

3. The carbon fiber according to claim 1, which is obtained by subjecting, to an oxidation treatment and a carbonization treatment, an acrylic fiber having an orientation degree of 90.5% or less when measured by wide-angle X-ray diffractometry (diffraction angle: 17°).

4. The carbon fiber according to claim 1, which is obtained by firing an oxidized fiber showing a mass reduction ratio of 7% or less when immersed in dimethylformamide for 12 hours.

* * * * *